United States Patent [19]

Kaneko et al.

[11] Patent Number: 4,570,274

[45] Date of Patent: Feb. 18, 1986

[54] DEVICE FOR WASHING POSTERIOR PARTS OF HUMAN BODY

[75] Inventors: Kenichi Kaneko, Kariya; Yuji Hirashiba; Shinji Kawai, both of Toyota; Koichi Suzuki, Chiryu, all of Japan

[73] Assignee: Aisin Seiki Kabushiki Kaisha, Kariya City, Japan

[21] Appl. No.: 655,613

[22] Filed: Sep. 28, 1984

[51] Int. Cl.[4] ..... E03D 9/08

[52] U.S. Cl. ..... 4/443

[58] Field of Search ..... 4/443, 444–448, 4/420.1, 420.2, 420.3, 420.4

[56] References Cited

U.S. PATENT DOCUMENTS 4,451,942 6/1984 Hirano et al. ..... 4/443

FOREIGN PATENT DOCUMENTS 3336461 5/1984 Fed. Rep. of Germany ..... 4/443

59-179941 10/1984 Japan .

*Primary Examiner*—Stephen Marcus

*Assistant Examiner*—L. J. Peters

*Attorney, Agent, or Firm*—Sughrue, Mion, Zinn, Macpeak, and Seas

[57] ABSTRACT

A device for washing the posterior parts of the human body includes an electrically operated driving means which moves a nozzle means certainly either to a first position for washing the anal area or to a second position for washing the female genitals, independently of the hydraulic pressure used. The nozzle means can be shifted forward or backward from the first or second position within a given range according to the instruction from the user.

5 Claims, 7 Drawing Figures

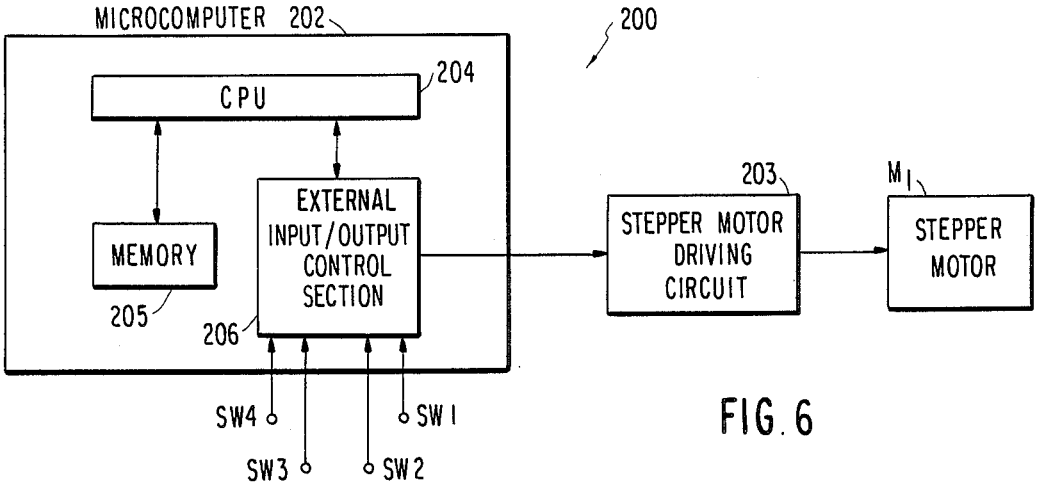
FIG. 6
FIG. 7
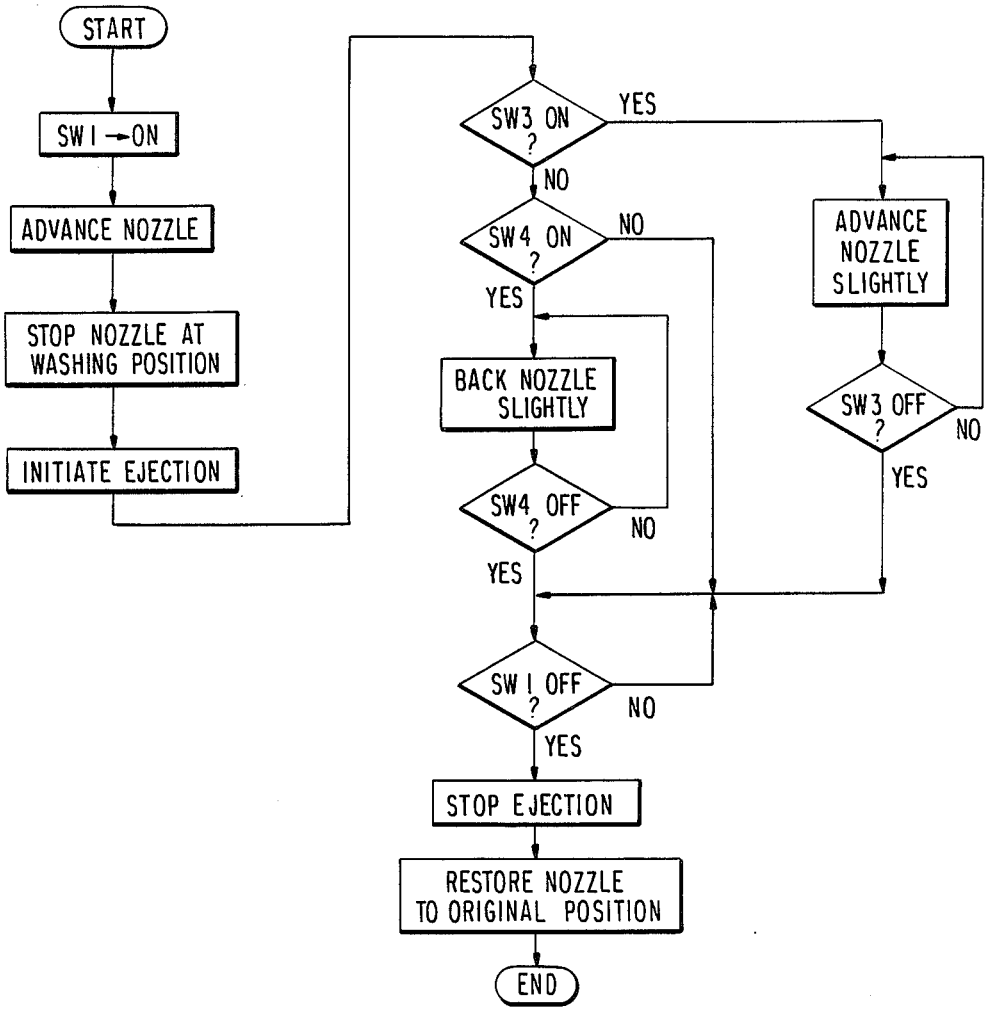

DEVICE FOR WASHING POSTERIOR PARTS OF HUMAN BODY

BACKGROUND OF THE INVENTION

1. Field of the Invention

The present invention relates to a device for washing the posterior parts of the human body and, more particularly, to a device which is capable of washing the anal area after defecation and also bathing the female genitals (i.e., acting as a bidet).

2. Description of the Prior Art

In a conventional washing device of this kind, a nozzle for ejecting warm water is disposed at the rear of the wall of the toilet bowl in such a way that the nozzle is caused to expand or contract in the direction perpendicular to the wall by the action of hydraulic pressure.

In this arrangement making use of hydraulic pressure, if any unexpected change occurs in the hydraulic pressure, the velocity at which the nozzle expands or contracts will be altered. Also, if the hydraulic pressure becomes less than a predetermined level, the nozzle will not be able to expand to a preset position. Another disadvantage arises from the fact that the position at which washing of the anal area of the body or of the female genitals is performed is fixed in spite of various sitting positions assumed by users which range from children to adults, the position depending on the quantity of expansion of the nozzle. Thus, it is not possible to adjust the position of the washing minutely. Hence, the user has been urged to precisely control the position at which he or she sits.

SUMMARY OF THE INVENTION

Accordingly, it is the object of the present invention to provide a device which acts to wash the posterior parts of the human body and which is free of the foregoing difficulties.

BRIEF DESCRIPTION OF THE DRAWINGS

FIG. 6 is a block diagram of a control circuit for an electrically operated driving means; and FIG. 7 is a flowchart illustrating the steps of operation performed by the control circuit shown in FIG. 6.

DETAILED DESCRIPTION OF THE PREFERRED EMBODIMENT

Figure 1:
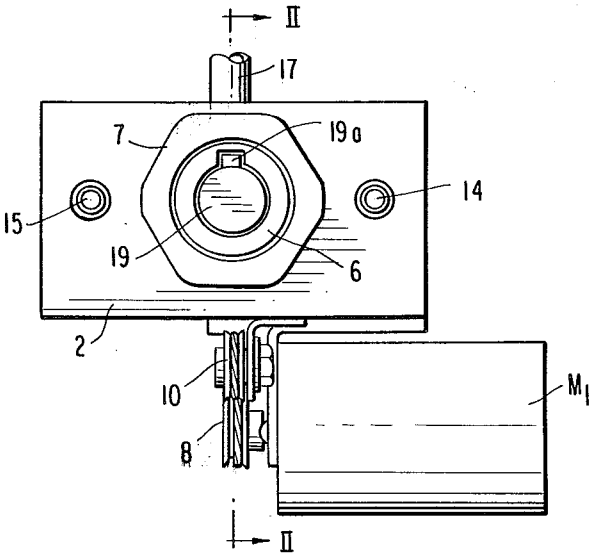
FIG. 1 is a side elevation of a device for washing the posterior parts of the human body, the device being fabricated according to the present invention.

Referring to the accompanying drawings, there is shown a device embodying the concept of the present invention. This device includes a stationary frame 2 which is fixed to a toilet bowl W by a nut 7 via spacers 3 and 4 made of rubber, a washer 5, and a nozzle guide 6. A stepper motor $M_1$ that can rotate in either of two opposite directions is mounted to the bottom of the frame 2. The rotating force of the motor $M_1$ is transmitted to pulleys 10 and 11 via another pulley 8 and a wire 9 or other member trained around the pulleys 8, 10 and 11. The pulleys 10 and 11 are rotatably mounted to the bottom of the frame 2 via stays 10A and 11A, respectively. Both ends of the wire 9 are affixed to the lower end of a movable member 12. Thus, when the pulley 8 fixed to the shaft of the motor $M_1$ is rotated counterclockwise, for example, as viewed in FIG. 2, the wire 9 is pulled in the direction indicated by the arrow to move the movable member 12 together with the inner nozzle 13 and a stepper motor $M_2$ in the direction indicated by the arrow a. This direction will hereinafter be referred to as the forward direction, while the opposite direction indicated by the arrow a' will be referred to as the backward direction. To make this movement smooth, the movable member 12 is guided by two guide rods 14 and 15 (see FIG. 4) whose opposite ends are firmly secured to the frame 2.

The rear end portion of the nozzle 13 is rotatably fitted in a hole formed in the movable member 12. The rotating shaft 16 of the motor $M_2$ is fitted in the end surface of the rear end portion of the nozzle 13 such that the shaft 16 can turn with the nozzle 13.

A fluid passage **13*a* is formed which extends axially through the center of the inner nozzle 13. The rear end of the passage 13*a* communicates via grooves 13*b* and 13*c* with the passage inside a member 17 for mounting an external water inlet pipe. The groove 13*b* is formed at a radially higher position. The groove 13*c*** is formed along the outer periphery and annular in shape.

A plug 18 has been driven in the front end of the inner nozzle 13. Three small holes 131, four small holes 132, and five small holes 133 are formed at three positions that are circumferentially equally spaced apart from each other at the front end (see FIG. 3). It is to be noted that it is not essential to the invention that these three positions are equally spaced apart. An outer nozzle 19 made from a resin is attached to the inner nozzle 13 by a retaining ring 20 between the nozzle guide 6 and the inner nozzle 13. The outer nozzle 19 is much shorter in axial length than the inner nozzle 13, and is provided with a protrusion **19*a* (see FIG. 1) at one location on its outer periphery. The protrusion 19*a* is rectangular in cross-sectional shape, and fits in a similarly shaped groove 6*a* in the nozzle guide 6. Accordingly, as the motor $M_2$ turns, the inner nozzle 13 is rotated about its axis, but the external nozzle 19 does not turn. When the inner nozzle 13 begins to move forward from the rearmost position shown in FIG. 2, however, the outer nozzle 19 is allowed to move together with the inner nozzle 13. When the outer nozzle 19 moves a distance equal to its axial length, the protrusion 19*a* comes out of engagement with the groove 6*a*. Then, the nozzles 13 and 19** can rotate together about their axis.

Figure 2:
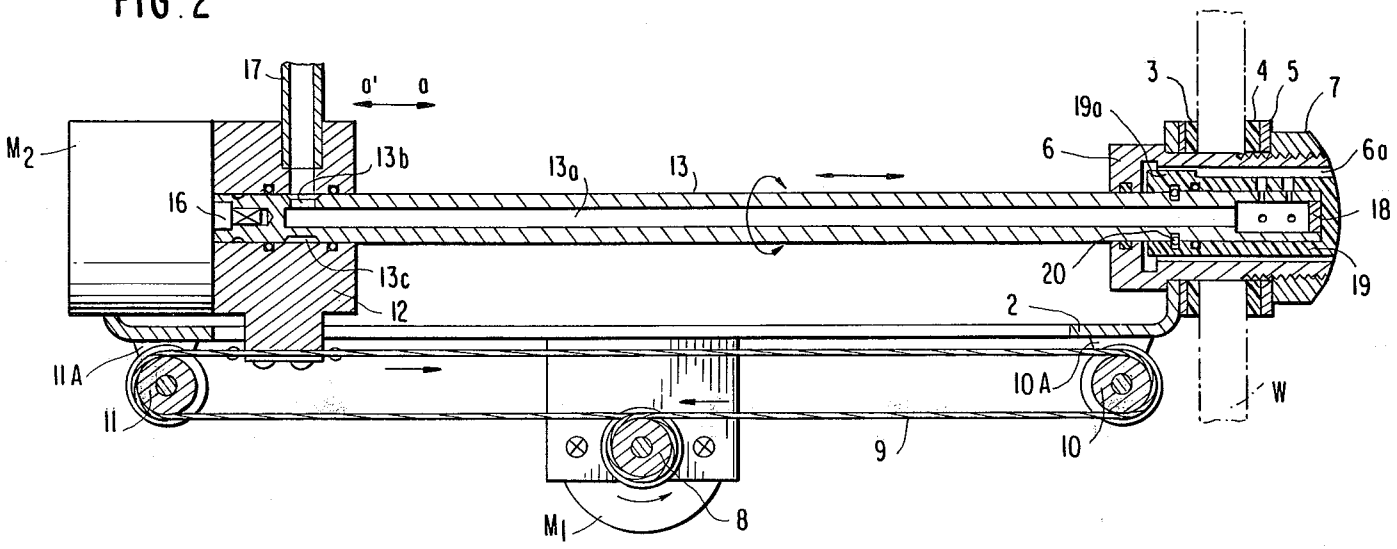
FIG. 2 is a cross-sectional view taken along the arrow II—II of FIG. 1.
Figures 3, 4, 5:
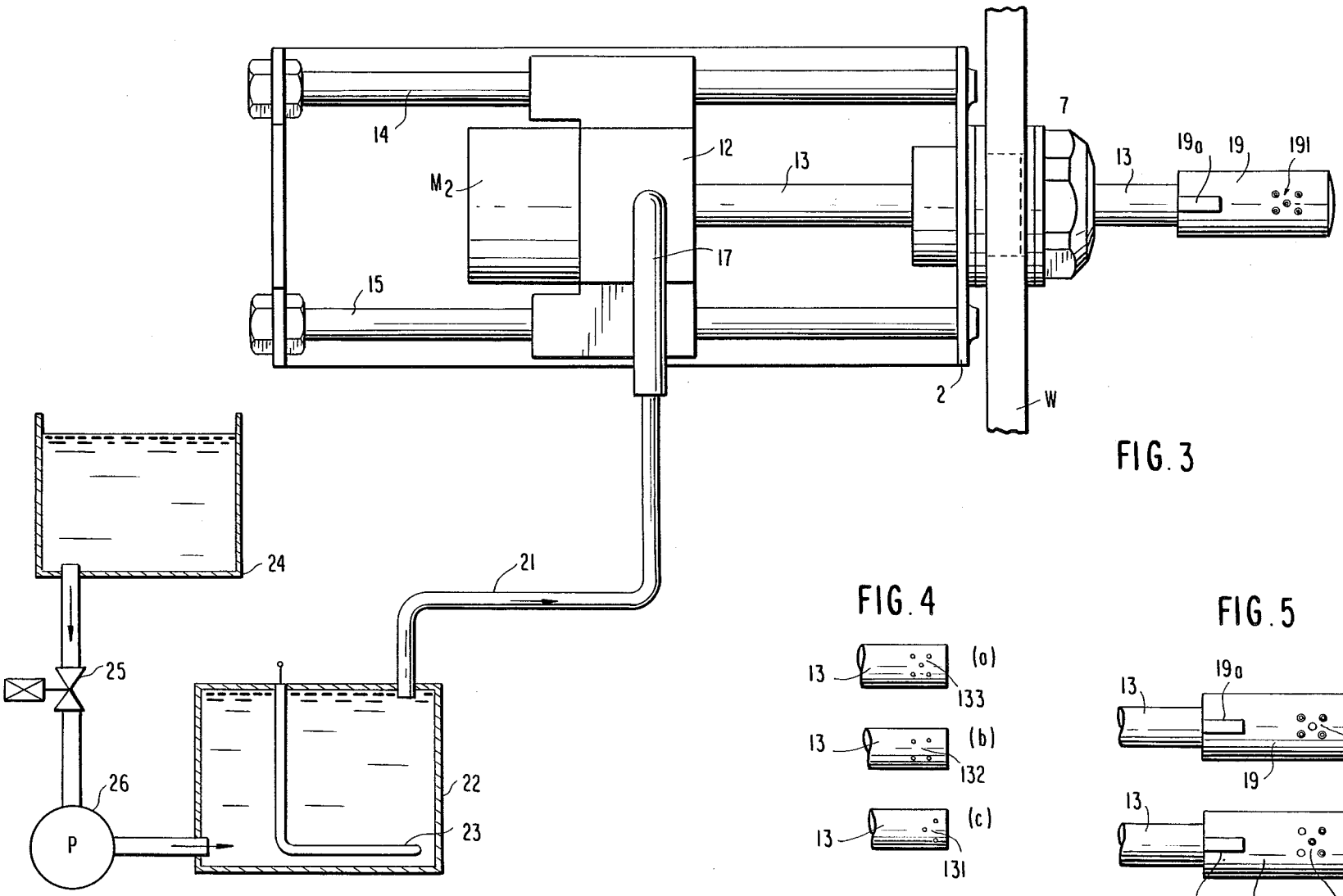
FIG. 3 is a fragmentary plan view of the front end portion of the inner nozzle 13 incorporated in the device shown in FIG. 1.
FIG. 4 is a plan view corresponding to FIG. 2, but in which a washing water supply means is also shown.
FIG. 5 is a fragmentary plan view of the front end portion of the outer nozzle 19 incorporated in the device shown in FIG. 1.

As shown in FIGS. 4 and 5, the outer nozzle 19 is provided with five small holes 191 which can be brought into register with the aforementioned five holes 133, four holes 132, or three holes 131 formed in the inner nozzle 13, as shown in FIGS. 4 and 5(*a*) and (*b*). The holes 191 in the outer nozzle 19 are made larger in cross-sectional area than the holes 131–133 in the inner nozzle. The registry is achieved by rotating the inner nozzle 13 by the action of the motor $M_2$ while the outer nozzle 19 is received in the nozzle guide 6 as shown in FIG. 2. Since the motor $M_2$ is a stepper motor, it is possible to selectively bring the holes in the nozzles 13 and 19 into registry as described above by controlling the rotational frequency or the angular step of the motor in automatic or manual manner. When two sets of holes register with each other in this way and water is introduced into the inner nozzle 13 at a certain pressure, washing water is ejected upward from one set of the holes 131–133.

Although the holes 191 in the outer nozzle 19 are circular in cross-sectional shape, the shape is not limited to this, but rather any other shape may be employed as long as it is greater in cross-sectional area than the holes 131–133 and permits the washing water to be ejected without experiencing resistance.

FIG. 4 is a plan view corresponding to FIGS. 1 and 2 and shows a means for forcing the washing water into the passage 13*a* in the inner nozzle 13. Also, the figure shows the condition in which the movable member 12 has moved a slight distance forward. Indicated by reference numeral 21 in this figure is a water guide pipe 21 having one end connected to the aforementioned mounting member 17, the other being connected to the upper portion of a warm water tank 22. A heater 23 is disposed in the tank 22 to warm the water within the tank. Water is supplied to the lower portion of the tank 22 from a water supply tank 24 through a solenoid valve 25 and a pump 26. When the present device is not in use, the valve 25 is closed to prevent the washing water from dripping from the front ends of the nozzles 13 and 19.

The inner nozzle 13 is driven by an electrically operated means 200, which is now described in somewhat detail by referring to FIGS. 6 and 7. The stepper motor $M_1$ is controlled by a circuit 201 consisting of a microcomputer 202 and a stepper motor driving circuit 203 that is controlled by the microcomputer. This microcomputer 202 incorporates a CPU 204, a memory 205, and an external input/output control section 206. Connected to the control section 206 are a first switch SW1, a second switch SW2, a third switch SW3, and a fourth switch SW4. When the first switch SW1 or the second switch SW2 is closed, the stepper motor $M_1$ makes a predetermined number of revolutions, the number being previously stored in the memory 205. Then, the movable member 12 is advanced to move the front end 19 of the nozzle 13 to a position for washing the anal area of the human body or another position for washing the female genitals, whereupon the nozzle 13 is halted. Under this condition, as long as the third switch SW3 or the fourth switch SW4 is maintained closed, the nozzle 13 moves forward or backward step by step within a given range. The present device is so designed that when the nozzle 13 comes to a halt in either position for washing, the solenoid valve 25 is opened and, at the same time, the pump 26 is operated to eject washing water from the nozzle 13. This ejection stops when the first switch SW1 or the second switch SW2 is opened. Note that the first switch SW1 and the second switch SW2 cannot be closed simultaneously. Similarly, the third switch SW3 and the fourth switch SW4 cannot be closed at the same time.

In the operation of the structure thus far described, when a switch (not shown) is depressed, the motor $M_2$ starts, rotating the inner nozzle 13 about its axis. Then, any one set of the three holes 131, four holes 132, and five holes 133 is brought into registry with the holes 191. Thus, the quantity of water ejected and the area of ejection, or washing area, can be controlled.

Then, if the first switch SW1 is closed, the motor $M_1$ makes a rotary motion, which is then converted into a rectilinear motion of the belt 9. This shifts the movable member 12, and the nozzle 13 attached to the movable member 12 is advanced to the position for washing the anal area and then stops, whereupon the solenoid valve 25 is opened. At the same time, the pump 23 is started to operate to force the cool water in the tank 24 into the tank 22. This pressure causes the warm water in the tank 22 to be supplied into the nozzle 23, and then it is emitted as washing water. At this time, if the position from which the water is ejected is judged to be inappropriate by the user, and if the user closes the third switch SW3 or the fourth switch SW4, then the nozzle 13 is moved forward or backward to select the optimum washing position. Then, if the first switch SW1 is opened, the operation of the pump ceases, and the solenoid valve 25 is closed. This stops the ejection of the washing water from the nozzle 13, followed by a reverse rotation of the motor $M_1$ to withdraw the nozzle 13. The operation for washing the female genitals is the same as the operation for washing the anal area except that the second switch SW2 is closed.

What is claimed is:

1. A device for washing the posterior parts of the human body, the device comprising:

a nozzle means extending in a toilet bowl so as to be movable forward and backward;

an electric motor operated driving means for moving the nozzle means either to a position for washing the anal area or to another position for washing the female genitals, the driving means further acting to move the nozzle means forward or backward within a given range according to the instruction from the user after the nozzle means has halted in one of the two positions;

a tank for storing warm water; and a pressure means for forcing cold water into the tank so that the warm water driven out of the tank may be ejected from the ejection hole of the nozzle means.

2. A device for washing the posterior parts of the human body as set forth in claim 1, wherein the electric motor operated driving means is composed of a movable member securely fixed to the rear end of the nozzle means at the rear of the toilet bowl and being capable of moving forward or backward along a rail means, an electric motor, a converter means placed between the motor and the movable member and acting to move the movable member back and forth in response to the rotary motion of the motor, and a control circuit for controlling the rotation of the motor.

3. A device for washing the posterior parts of the human body as set forth in claim 2, wherein the motor is a stepper motor.

4. A device for washing the posterior parts of the human body as set forth in claim 2, wherein the control circuit includes first, second, third, and fourth switches, and wherein the device is so designed that when the first switch is closed, the nozzle means advances to the position for washing the anal area and stops in this position and that when the second switch is closed, the nozzle means advances to the position for washing the female genitals and stops in this position, the nozzle means moving forward or backward within a given range when the first or second switch is closed and the third and fourth switches are closed.

5. A device for washing the posterior parts of the human body as set forth in claim 2, wherein the converter means consists of a pair of guide rollers rotatably mounted to the lower portion of a retaining body, a driving roller rotating with the motor, and a belt trained around the driving roller, the retaining body supporting the front and rear ends of the rail means, both ends of the belt being guided by the guide rollers and fixed to the lower portion of the movable member.

* * * * *